US008193709B2

(12) United States Patent
Chung et al.

(10) Patent No.: US 8,193,709 B2
(45) Date of Patent: Jun. 5, 2012

(54) PLASMA DISPLAY PANEL

(75) Inventors: Woo-Joon Chung, Suwon-si (KR); Tae-Jun Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 47 days.

(21) Appl. No.: 12/453,649

(22) Filed: May 18, 2009

(65) Prior Publication Data

US 2009/0289543 A1 Nov. 26, 2009

(30) Foreign Application Priority Data

May 22, 2008 (KR) ..... 10-2008-0047430

(51) Int. Cl.
*H01J 17/49* (2006.01)

(52) U.S. Cl. ..... 313/585; 313/582

(58) Field of Classification Search ..... 313/582–587
See application file for complete search history.

(56) References Cited

U.S. PATENT DOCUMENTS

| | | | | |
|---|---|---|---|---|
| 6,295,040 | B1 | 9/2001 | Nhan et al. | |
| 6,909,225 | B1 * | 6/2005 | Irie et al. | 313/112 |
| 7,071,621 | B1 | 7/2006 | Namiki et al. | |
| 7,132,795 | B2 | 11/2006 | Kim et al. | |
| 7,230,379 | B2 | 6/2007 | Kwon et al. | |
| 7,564,187 | B2 | 7/2009 | Kang et al. | |
| 2002/0021090 | A1 | 2/2002 | Sano et al. | |
| 2002/0135303 | A1 | 9/2002 | Hashimoto | |
| 2003/0209982 | A1 | 11/2003 | Kim et al. | |
| 2005/0082978 | A1 * | 4/2005 | Kwon et al. | 313/583 |
| 2005/0093449 | A1 * | 5/2005 | Su et al. | 313/584 |
| 2006/0279212 | A1 * | 12/2006 | Ahn | 313/582 |
| 2008/0257863 | A1 | 10/2008 | Kitsunai et al. | |

FOREIGN PATENT DOCUMENTS

| | | | |
|---|---|---|---|
| CN | 1 258 203 | C | 12/2003 |
| CN | 1 925 095 | A | 3/2007 |
| JP | 09-115450 | A | 5/1997 |
| JP | 10-144225 | | 5/1998 |
| JP | 2000-243299 | A | 9/2000 |
| JP | 2000-306515 | A | 11/2000 |
| JP | 2001-345054 | A | 12/2001 |
| JP | 2003-331741 | | 11/2003 |
| JP | 2005-056925 | A | 3/2005 |
| JP | 2005-071953 | A | 3/2005 |
| JP | 2005-123191 | A | 5/2005 |
| JP | 2005-203153 | | 7/2005 |
| KR | 10 2004-0023192 | A | 3/2004 |
| KR | 10 2006-0067420 | A | 6/2006 |
| KR | 10-2007-0005337 | A | 1/2007 |
| KR | 10 2007-0005337 | A | 1/2007 |

OTHER PUBLICATIONS

Chinese Patent Gazette dated Feb. 23, 2011, with English Translation.

* cited by examiner

*Primary Examiner* — Anne Hines
(74) *Attorney, Agent, or Firm* — Lee & Morse, P.C.

(57) ABSTRACT

A plasma display panel includes a pair of substrates facing each other, barrier ribs defining discharge cells between the pair of substrates, sustain electrodes between the pair of substrates, the sustain electrodes including second bus electrodes along a first direction, the second bus electrodes being on the barrier ribs, scan electrodes between the pair of substrates, the scan electrodes including first bus electrodes along the first direction, the first bus electrodes being positioned between adjacent second bus electrodes, address electrodes between the pair of substrates, the address, scan, and sustain electrodes being configured to generate discharge in the discharge cells, and phosphors in the discharge cells, the phosphors being configured to emit light by the discharge.

17 Claims, 7 Drawing Sheets

PLASMA DISPLAY PANEL

BACKGROUND OF THE INVENTION

1. Field of the Invention

Example embodiments relate to a plasma display panel (PDP). In particular, example embodiments relate to a PDP including a cell structure capable of expanding a discharge margin and increasing efficiency in all load regions.

2. Description of the Related Art

A PDP refers to a digital display device that displays images by generating plasma between two sheets of glass substrates and allowing phosphor to emit light with plasma. The PDP may be manufactured as a large-sized and thin panel and may exhibit improved natural color reproducibility and rapid driving, as compared, e.g., to a cathode ray tube (CRT) display.

The conventional PDP may include electrodes between a pair of substrates, a dielectric electrically isolating the electrodes, barrier ribs forming a discharge space between the pair of substrates, and phosphors arranged in the discharge space and emitting light by the discharge. A driving circuit may process image signals received from an external source, and may supply the processed image signals to the electrodes to control the PDP, thereby displaying an image on a screen of the PDP. The PDP may include several tens to several millions of pixels arranged, e.g., in a matrix form.

The barrier ribs may partition the discharge space between the pair of substrates into a plurality of discharge cells, e.g., several tens to several millions. For example, the discharge cells may be defined by a conventional square barrier rib structure or by a conventional double barrier rib structure.

For example, the conventional square barrier rib structure may have a stripe pattern to define discharge cells in a stripe pattern. The discharge cells defined by the conventional square barrier rib structure may secure a wide discharge space, as compared to the double barrier rib structure, to exhibit a relatively high discharge margin and high luminance per discharge. However, since the electrodes may cross the barrier ribs in the conventional square barrier rib structure, a portion of the light emitting region in the discharge cells defined by the conventional square barrier rib structure may be covered by the electrodes, i.e., the bus electrodes. Accordingly, an aperture ratio in such discharge cells may be small, thereby reducing efficiency of visible light.

In another example, conventional double barrier rib structure may have a grid pattern to define discharge cells in a matrix pattern. The discharge cells defined by the conventional double barrier rib structure may have a large aperture ratio, as compared to the conventional simple square barrier rib structure. However, since the discharge cells have a matrix pattern, the discharge space may be small, so the discharge margin may be poor and the luminance may be low per discharge.

Further, while discharge cells defined by the conventional double barrier rib structure may have luminance efficiency in a large discharge load region, as compared to discharge cells defined by the conventional square barrier rib structure, in about 10% to about 30% load condition that is an actual moving picture condition, the discharge cells defined by the conventional double barrier rib structure may show lower efficiency characteristic than the discharge cells of the conventional square barrier rib structure. This is because the discharge cells defined by the conventional double barrier rib structure may have more sustain pulses than the discharge cells of the conventional square barrier rib structure and may increase reactive power consumption due to the increase of the number of pulses.

SUMMARY OF THE INVENTION

Example embodiments are therefore directed to a PDP, which is capable of overcoming the disadvantages and shortcomings of the related art.

It is therefore a feature of an example embodiment to provide a low-voltage drivable PDP including an improved cell structure.

It is another feature of an example embodiment to provide a PDP having improved driving voltage margin in all loads by limiting discharge current while maximizing a discharge space.

It is yet another feature of an example embodiment to provide a PDP including an improved cell structure having a high aperture ratio and a large discharge space.

At least one of the above and other features may be realized by providing a PDP, including a pair of substrates facing each other, barrier ribs partitioning discharge cells between a pair of substrates, scan electrodes, sustain electrodes, and address electrodes arranged between the pair of substrates and generating discharge in the discharge cell, and phosphors arranged in the discharge cell and emitting light by the discharge, the scan electrode including a first bus electrode and the sustain electrode including a second bus electrode, the second bus electrode being arranged on the barrier ribs extended in a first direction, and the first bus electrode being arranged between neighboring second bus electrodes.

The first bus electrode and the second bus electrode may be arranged at equidistance. The first bus electrodes may be positioned at substantially equal distances from both adjacent second bus electrodes, the distances being measured along a second direction orthogonal to the first direction The scan electrode may contact the first bus electrode and may include a first transparent electrode having a wider width than the first bus electrode. The sustain electrode may contact the second bus electrode and may include a second transparent electrode having a wider width than a second bus electrode. The first bus electrode may be arranged on one side width end of the first transparent electrode positioned at a discharge gap portion where the first transparent electrode and the second transparent electrode is adjacent each other. The second bus electrode may be arranged on the other side width end of the second transparent electrode facing the one side width end of the second transparent electrode positioned at the discharge gap portion.

The first transparent electrode and the second transparent electrode may extend in a first direction.

At least one of the first transparent electrode, the first bus electrode, the second transparent electrode, and the second bus electrode may include at least one bending portion.

The scan electrode may include the first transparent electrode contacting the first bus electrode and the sustain electrode may have the second transparent electrode contacting the second bus electrode. The first transparent electrode may extend to the barrier rib from the central portion between two adjacent barrier ribs based on the first bus electrode and may include a wider width than the first bus electrode. The second transparent electrode may extend to the central portion between two adjacent barrier ribs on the barrier rib based on the second bus electrode and may include a wider width than the second bus electrode.

At least one of the first bus electrode and the second bus electrode may include a bending portion, the bent portion extending in the first direction and being bent according to an arrangement of the barrier rib and the discharge cell.

The scan electrode may have non-uniform widths along a second direction, the second direction being substantially orthogonal to the first direction. The scan electrodes may have different widths in each discharge cell, the widths being configured according to the difference in the luminance of phosphor arranged in the discharge cells.

The barrier rib may include a first barrier rib extending in the first direction and a second barrier rib extending to a second direction orthogonal to the first direction.

The barrier ribs may completely overlap the second bus electrodes, and the first bus electrodes may extend between adjacent barrier ribs along center portions of the discharge cells. Each first bus electrode may extend along an entire length of at least one corresponding discharge cell. Each first bus electrode may extend along a plurality of corresponding discharge cells. The scan and sustain electrodes may include respective first and second transparent electrodes on corresponding first and second bus electrodes to define a discharge gap therebetween, the first and second bus electrodes and the first and second transparent electrodes being positioned to define the discharge gap to be offset with respect to a center of the discharge cell.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION OF THE INVENTION

Figure 1:
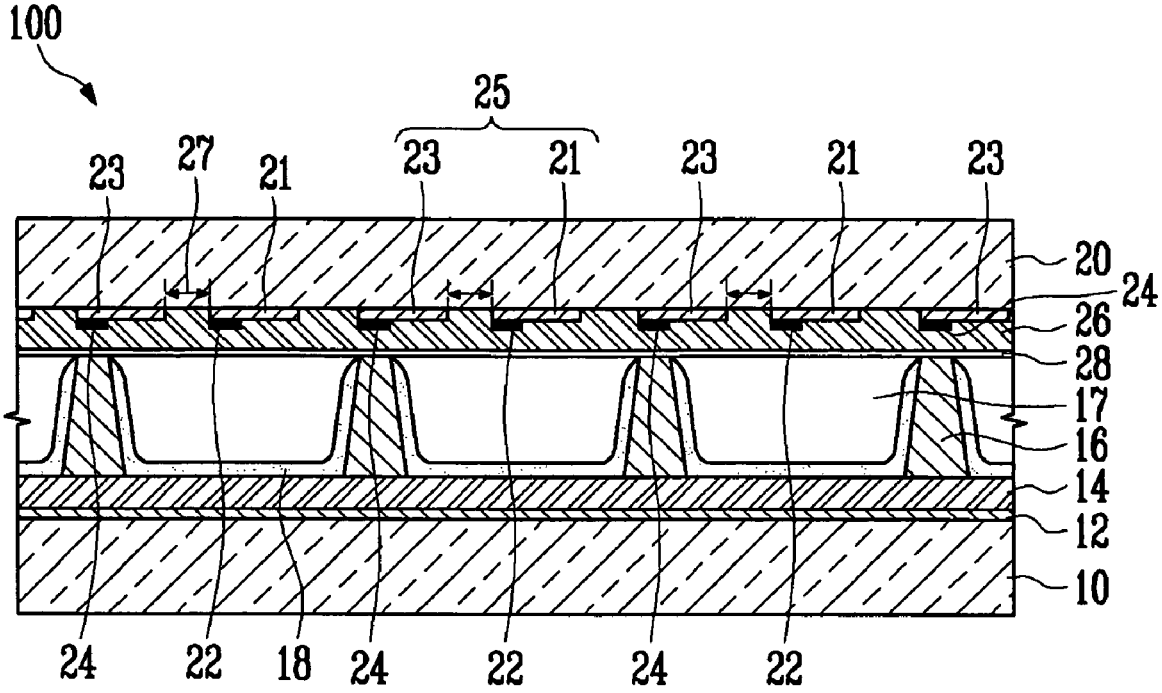
FIG. 1 illustrates a partial cross-sectional view of a PDP according to an example embodiment.

Korean Patent Application No. 10-2008-0047430, filed on May 22, 2008, in the Korean Intellectual Property Office, and entitled: "PDP," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. In addition, it will also be understood that when a layer is referred to as being "between" two layers, it can be the only layer between the two layers, or one or more intervening layers may also be present. Further, as used herein, the terms "a" and "an" are open terms that may be used in conjunction with singular items or with plural items. Like reference numerals refer to like elements throughout.

FIG. 1 illustrates a partial cross-sectional view of a PDP according to an example embodiment. FIG. 1 corresponds to a cross section of a PDP 100. It is noted, for reference, that if an exploded view of the PDP 100 were oriented as a PDP 100*a* of FIG. 2A, the cross section of FIG. 1 would be oriented along line I-I' of FIG. 2A. Similarly, the cross section of FIG. 1 may correspond to line I-I' of FIG. 2B. In other words, FIG. 1 may illustrate a cross-section of a PDP having a double barrier rib structure or a square barrier rib structure (respective FIGS. 2A and 2B).

It is further noted that in the following embodiments, a scan electrode may include a first bus electrode and a first transparent electrode, and a sustain electrode may include a second bus electrode and a second transparent electrode. However, for convenience of explanation, the first transparent electrode may be simply referred to as the scan electrode upon being clearly different from the first bus electrode, and the second transparent electrode may be simply referred to as a sustain electrode upon being clearly different from the second bus electrode.

Referring to FIG. 1, the PDP 100 may include a lower substrate 10, an address electrode 12 arranged on the lower substrate 10, a lower dielectric 14 covering the address electrode 12, a barrier rib 16 arranged on the lower dielectric 14, a phosphor 18 arranged in a discharge space partitioned by the barrier rib 16, an upper substrate 20 arranged facing the lower substrate 10, a pair of display electrodes 25, i.e., a scan electrode and a sustain electrode, arranged on the upper substrate 20, a first bus electrode 22 arranged on the scan electrode 21 and a second bus electrode 24 arranged on the sustain electrode 23, an upper dielectric 26 covering the first bus electrode 22, the sustain electrode 23, the second bus electrode 24, and the scan electrode 21, and a passivation film 28 covering the upper dielectric 26.

The barrier ribs 16 may be formed on the lower substrate 10 in any suitable configuration, e.g., in a stripe pattern or a grid pattern, to define a plurality of discharge cells 17 in the PDP 100. That is, the PDP 100 may include several tens to several millions of discharge cells 17 in order to display an image on a screen by the plasma discharge. A discharge cell is a basic unit configuring on the screen and may be operated to display at least one discharge cell 17 via a group of electrodes 12, 21, and 23 generating the discharge in the discharge cell 17, and a gray scale by at least one phosphor 18 emitting light by the discharge.

The first and second bus electrodes 22 and 24, the scan electrodes 21, and the sustain electrodes 23 may extend along a first direction. For example, the first and second bus electrodes 22 and 24, the scan electrodes 21, and the sustain electrodes 23 may extend along a substantially same direction as the barrier ribs 16, e.g., the first bus electrodes 22 may extend along longitudinal sides of discharge cells arranged between stripe-patterned barrier ribs 16. The scan and sustain electrodes 21 and 23 may be spaced apart from each other along a second direction, e.g., the scan and sustain electrodes 21 and 23 may be arranged in an alternating pattern. Each pair of scan and sustain electrodes 21 and 23 may correspond to at least one discharge cell 17 extending along the first direction. The first bus electrode 22 may be positioned on the scan electrode 21, i.e., the scan electrode 21 may be between the first bus electrode 22 and the upper substrate 20, to correspond to a center of the discharge cell 17. The second bus electrode 24 may be positioned on the sustain electrode 23, i.e., the sustain electrode 23 may be between the second bus electrode 24 and the upper substrate 20, to correspond to the barrier rib 16.

Each of the electrodes 21, 22, 23, and 24 may be arranged as follows. The second bus electrode 24 may be arranged on the upper surface of the barrier rib 16, the sustain electrode 23 may extend to a center of the discharge cell 17 from the second bus electrode 24, and the first bus electrode 22 may be arranged between the sustain electrode 23 with the discharge gap 27 and an adjacent barrier rib 16, and the scan electrode 21 may extend from the center of the discharge cell 17 arranged with the first bus electrode 22 to the adjacent barrier rib 16. Herein, the center of the discharge cell 17 refers to a central portion of the discharge cell 17, i.e., an intermediate portion in a discharge cell 17 that overlaps a central axis of the discharge cell 17 along the first direction and is positioned between two adjacent barrier ribs 16.

More specifically, the first bus electrode 22 may extend along the central portion of the discharge cell 17, i.e., to overlap a center portion extending along the first direction. The second bus electrode 24 may be arranged to extend along the upper surface of the barrier rib 16, i.e., a surface facing the upper substrate 20, so the barrier rib 16 may overlap, e.g., completely overlap, the second bus electrode 24.

The sustain electrode 23 may be wider than the second bus electrode 24 along the second direction, so the sustain electrode 23 may extend along the barrier rib 16 in the first direction and may overlap the barrier rib 16 and a portion of the discharge cell 17. In other words, a width of the sustain electrode 23 may extend in the second direction from the barrier rib 16, i.e., from the second bus electrode 24, toward the central portion of the discharge cell 17. For example, edges of the sustain electrode 23 and the second bus electrode 24 above the barrier rib 16 may be aligned, e.g., both edges may define a single flat plane along a normal to the upper substrate 20. The scan electrode 21 may be spaced apart from the sustain electrode 23, so a discharge gap 27 may be defined therebetween in the discharge cell 17, as illustrated in FIG. 1. As further illustrated in FIG. 1, a width of the scan electrode 21 in the second direction may extend from the discharge gap 27 toward an adjacent barrier rib 16. As illustrated in FIG. 1, edges of the scan electrode 21 and the first bus electrode 22 adjacent to the discharge gap 27 may be aligned, e.g., both edges may define a single flat plane along a normal to the upper substrate 20.

A width of the first bus electrode 22 and a width of the second bus electrode 24 may be substantially the same as or smaller than a width of the upper of the barrier rib 16. Widths of elements in FIG. 1 refer to a distance measured along the second direction, i.e., along a horizontal direction parallel to the lower substrate 10.

According to example embodiments, only one bus electrode of the first and second bus electrodes 22 and 24 may be arranged to overlap a discharge space of a discharge cell 17. In other words, the first bus electrode 22, i.e., the bus electrode of the scan electrode 21, may be arranged in the central portion of the discharge cell 17, thereby increasing a discharge margin and efficiency thereof. In contrast, a PDP with a conventional square barrier rib structure may have more than one opaque bus electrode in a discharge space of a discharge, thereby exhibiting reduced aperture ratio. Further, a PDP with a conventional double barrier rib structure and opaque bus electrodes at peripheral portions of a discharge cell, i.e., not arranged at a central portion of a discharge cell, may have poor discharge margin and low luminance per discharge due to small discharge space. Therefore, a PDP according to example embodiments with the first bus electrode 22 in the central portion of the discharge cell 17 may exhibit increased discharge margin and efficiency, and may have a relatively increased aperture ratio of the discharge cell 17 by reducing a width of the first bus electrode 22 along the second direction.

Further, since the first bus electrode 22 according to example embodiments may be arranged at the central portion of the discharge cell 17, the discharge gap 27 between the scan and sustain electrodes 21 and 23 may be offset with respect to a center of the discharge cell 17. For example, the discharge gap 27 may be closer to a barrier rib 16 adjacent to the sustain electrode 23 than to a barrier rib 16 adjacent to the scan electrode 21. Therefore, an asymmetry of the address discharge may be reduced, and the address discharge may be easily performed. Accordingly, the structure of the electrode according to example embodiments may provide a low voltage driving of the PDP 100.

In addition, if the second bus electrode 24 is arranged on the barrier rib 16, the discharge cell 17 may be maximized and the discharge current may be limited by the structure of the barrier rib 16, e.g., square structure. Therefore, the driving voltage margin of the PDP 100 may be increased in the entire load region.

In a conventional simple square barrier rib structure, the cell region may be covered by both the bus electrode of the scan electrode and the bus electrode of the sustain electrode. Since in the PDP 100 according to example embodiments the cell region may be covered only by the first bus electrode, i.e., since the second bus electrode is above a barrier rib, it may have a higher aperture ratio than the conventional simple square barrier rib structure. Further, the PDP 100 may have a larger discharge cell than the conventional double barrier rib structure. Therefore, the efficiency of the PDP 100 may be increased in all load regions.

Figure 2A:
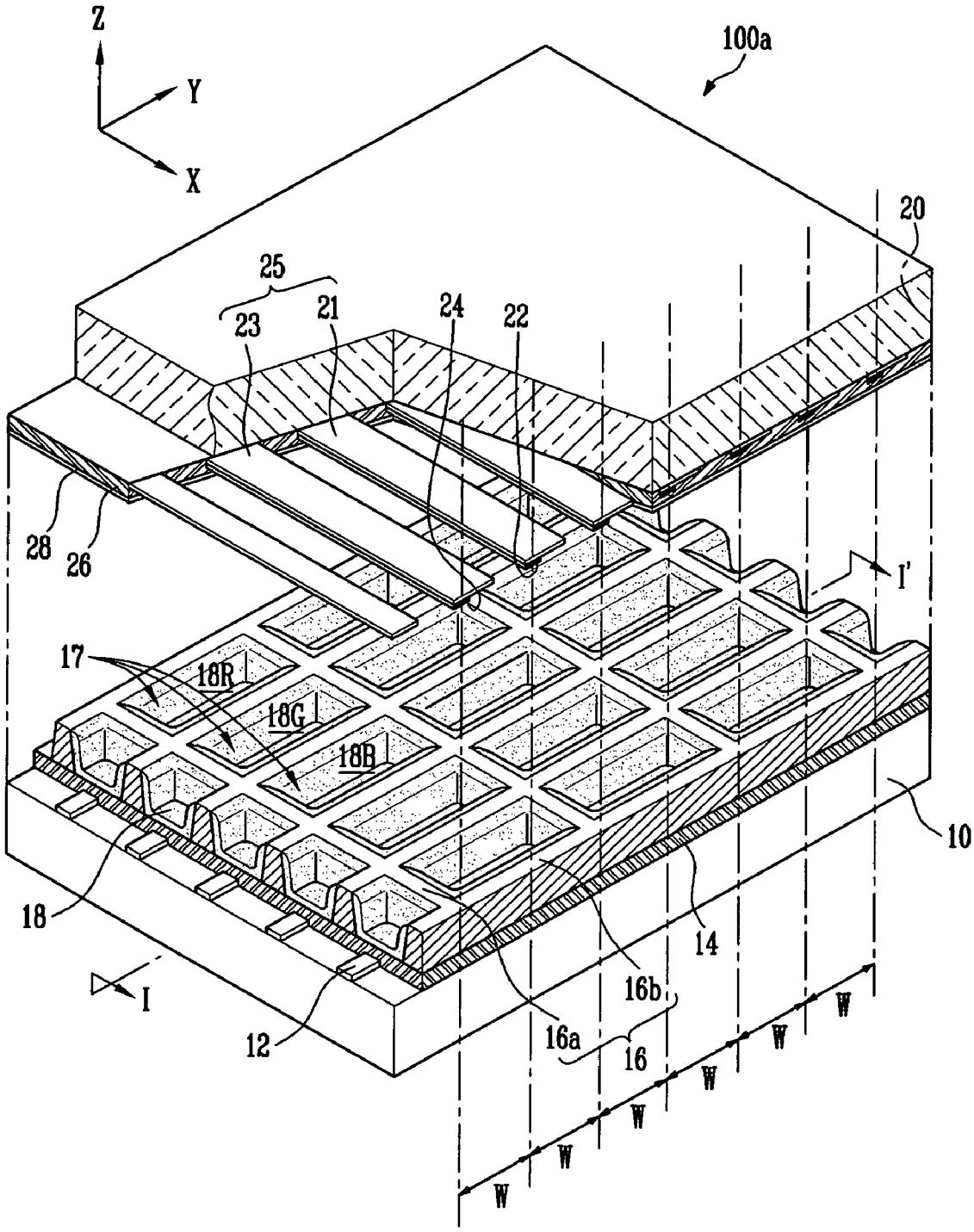
FIG. 2A illustrates an exploded perspective view of a PDP with a double barrier ribs structure according to another example embodiment.
Figure 2B:
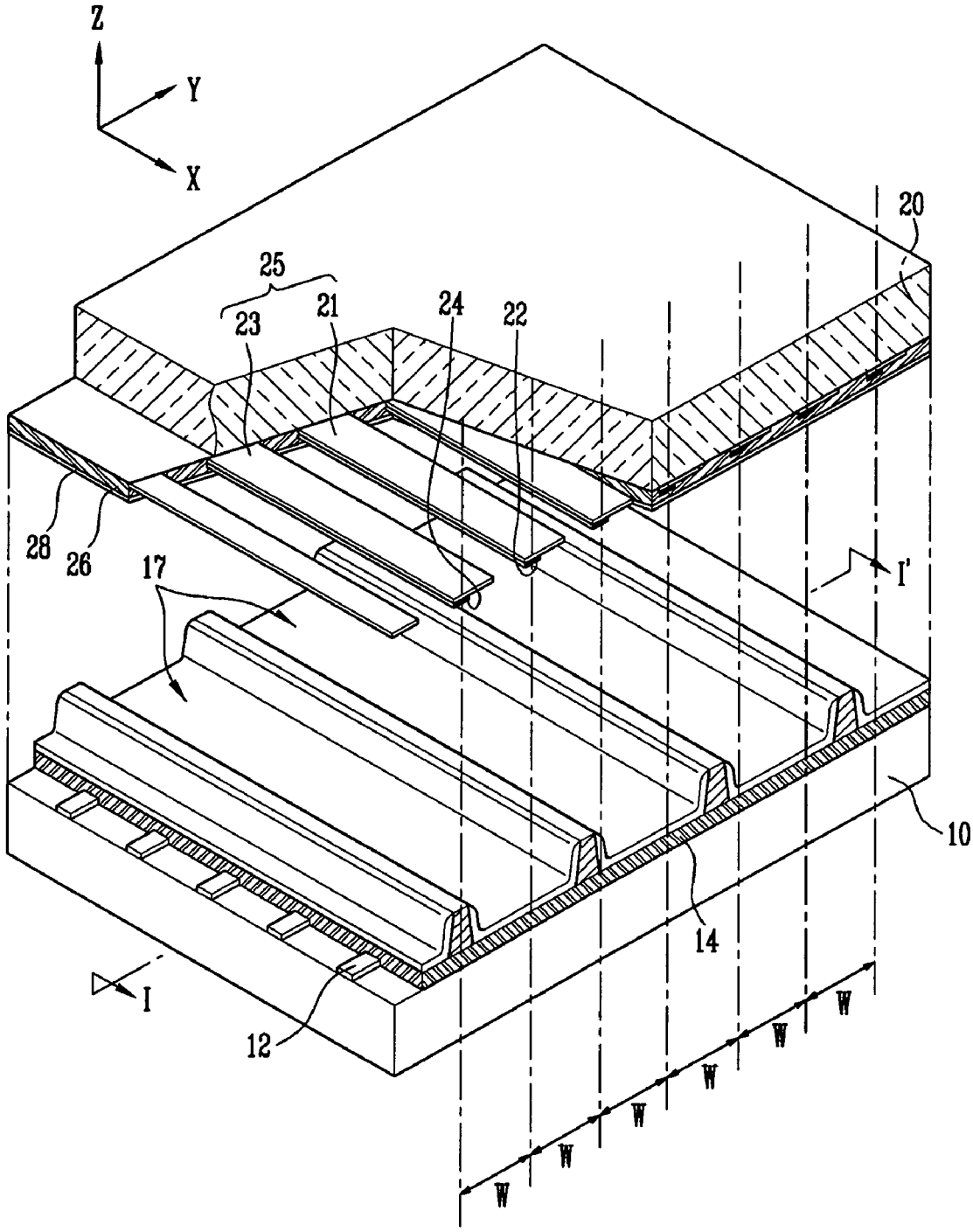
FIG. 2B illustrates an exploded perspective view of a PDP with a square barrier rib structure according to another example embodiment.

FIGS. 2A-2B illustrate partial exploded perspective views of PDPs according to other example embodiments. In FIGS. 2A-2B, the PDPs may be substantially the same as the PDP 100 of FIG. 1, with the exception of having the first and second bus electrodes arranged at substantially equal distances with respect to each other. FIG. 2A illustrates an exemplary arrangement of the barrier ribs in a grid pattern, i.e., double barrier rib structure. FIG. 2B may be substantially the same as the PDP of FIG. 2A, with the exception of having the barrier ribs in a stripe pattern, i.e., a square barrier rib structure.

Referring to FIG. 2A, the first bus electrode 22 and second bus electrode 24 of the PDP 100*a* may be arranged at a substantial equidistance W. At this time, the scan electrode 21 and the sustain electrode 23 including the transparent electrodes may be arranged at a substantial equidistance.

For example, as illustrated in FIG. 2A, the barrier rib 16 may include a first barrier rib 16*a* extending in the first direction, e.g., along the x-axis, where the first bus electrode 22 or the second bus electrode 24 may extend, and a second barrier rib 16*b* extending in the second direction, i.e., along the y-axis, where the address electrode 12 may extend. The second direction may be orthogonal to the first direction. A height of the second barrier rib 16*b* may be substantially the same as or lower than that of the first barrier rib 16*a*. It is noted that the second barrier rib 16*b* may be omitted, so only the first barrier ribs 16*a* may be formed in a stripe pattern (FIG. 2B).

As further illustrated in FIG. 2A, if barrier ribs 16 include first and second barrier ribs 16*a* and 16*b*, the discharge cells 17 may be formed in a matrix arrangement according to a matrix pattern shape of the group of electrodes. Further, as discussed previously with reference to FIG. 1, the first bus electrode 22 may correspond to a central portion of the discharge cell 17, and the second bus electrode 24 may be aligned above the first barrier rib 16*a*, so the first barrier rib 16*a* may overlap, e.g., completely overlap, the second bus electrode 24. As further illustrated in FIG. 2, the first and second bus electrodes 22 and 24 on corresponding scan and sustain electrodes 21 and 23 may be arranged in an alternating pattern, e.g., each first bus electrode 22 may be between two adjacent second bus electrodes 24. Further, as illustrated in FIG. 2, the first and second bus electrodes 22 and 24 may be spaced at equal distances from each other, e.g., the first bus electrode 22 may be spaced at the distance W from each adjacent second bus electrodes 24. Therefore, in addition to the advantages described previously with reference to the PDP 100 of FIG. 1, the manufacturing process of the PDP 100*a* may be simplified, and the operation of each discharge cell 17 may exhibit increased uniformity.

Figure 3:
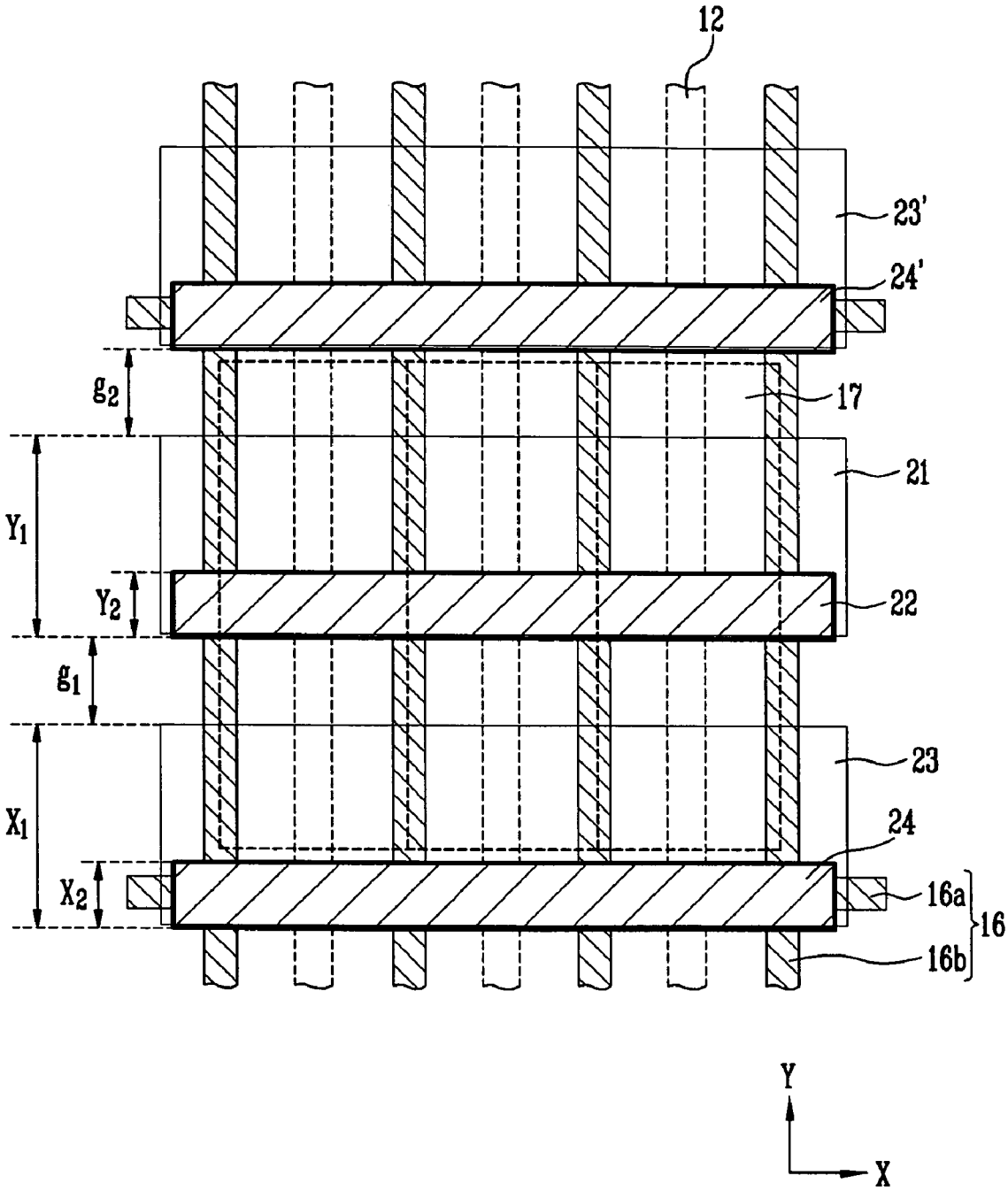
FIG. 3 illustrates a partial plan view of a cell structure in the PDP of FIG. 2.

FIG. 3 illustrates a partial, schematic plan view of a cell structure in the PDP 100*a* illustrated in FIG. 2. In FIG. 3, the thickness or size of each component including the first bus electrode 22 and the second bus electrode 24 may be expanded for convenience and clarity of explanation.

Referring to FIG. 3, the first bus electrode 22 may be arranged to extend in the first direction and to traverse central portions of a plurality of discharge cells 17 arranged in the first direction. In other words, the first bus electrodes 22 according to example embodiments may be arranged in a stripe pattern along central portions of the discharge cells 17 in the first direction.

The second bus electrode 24 may extend along the upper surface of the first barrier rib 16*a* in the first direction, where the first barrier rib 16*a* may extend. In other words, the second bus electrodes 24 according to example embodiments may extend in the stripe form on the upper surface of the first barrier rib 16*a* in the first direction. For example, as illustrated in FIG. 3, the first and second bus electrodes 22 and 24 may be arranged in an alternating pattern.

The first bus electrode 22 and the second bus electrode 24 may have lower electric resistance than the scan electrode 21 and/or the sustain electrode 23, and may be formed of materials not reacting with the dielectric. The scan electrode 21 and the sustain electrode 23 may be transparent. It is noted that the scan electrode 21 and the sustain electrode 23 refer to transparent electrodes of the display electrodes 25. Accordingly, each scan electrode of the display electrodes 25 may include the first bus electrode 22 and the scan electrode 21, and each sustain electrode of the display electrodes 25 may include the second bus electrode 24 and the sustain electrode 23.

The scan electrode 21 may extend together with the first bus electrode 22 in the first direction. A width Y1 of the scan electrode 21 may be wider than a width Y2 of the first bus electrode 22. The scan electrode 21 may extend from the central portion of the discharge cell 17 toward the adjacent first barrier rib 16*a* along the y-axis. In FIG. 3, the adjacent first barrier rib 16*a* may be a barrier rib positioned below the second bus electrode 24', as indicated by reference numeral 24' for convenience of explanation.

The sustain electrode 23 may extend together with the second bus electrode 24 in the first direction. A width X1 of the sustain electrode 23 may be wider than a width X2 of the second bus electrode 24. The sustain electrode 23 may extend to the central portion of the discharge cell 17 from the upper surface of the barrier rib 16*a* along the y-axis.

The scan electrode 21 and the sustain electrode 23 may be arranged to be spaced apart from each other at a predetermined discharge gap g1. The aforementioned scan electrode 21 may be arranged to be spaced from the sustain electrode 23' at a predetermined gap g2. Herein, the adjacent sustain electrode 23' may be indicated by reference numeral 23' for convenience of explanation and may be the sustain electrode contacting the aforementioned adjacent second bus electrode 24'. A size of the aforementioned discharge gap g1 and the size of another gap g2 may be substantially the same. In other words, since the first and second bus electrodes 22 and 24 may be positioned to have a constant distance W therebetween, a sum of distances X1 and g1 may substantially equal a sum of distances Y1 and g2.

Figure 4A:
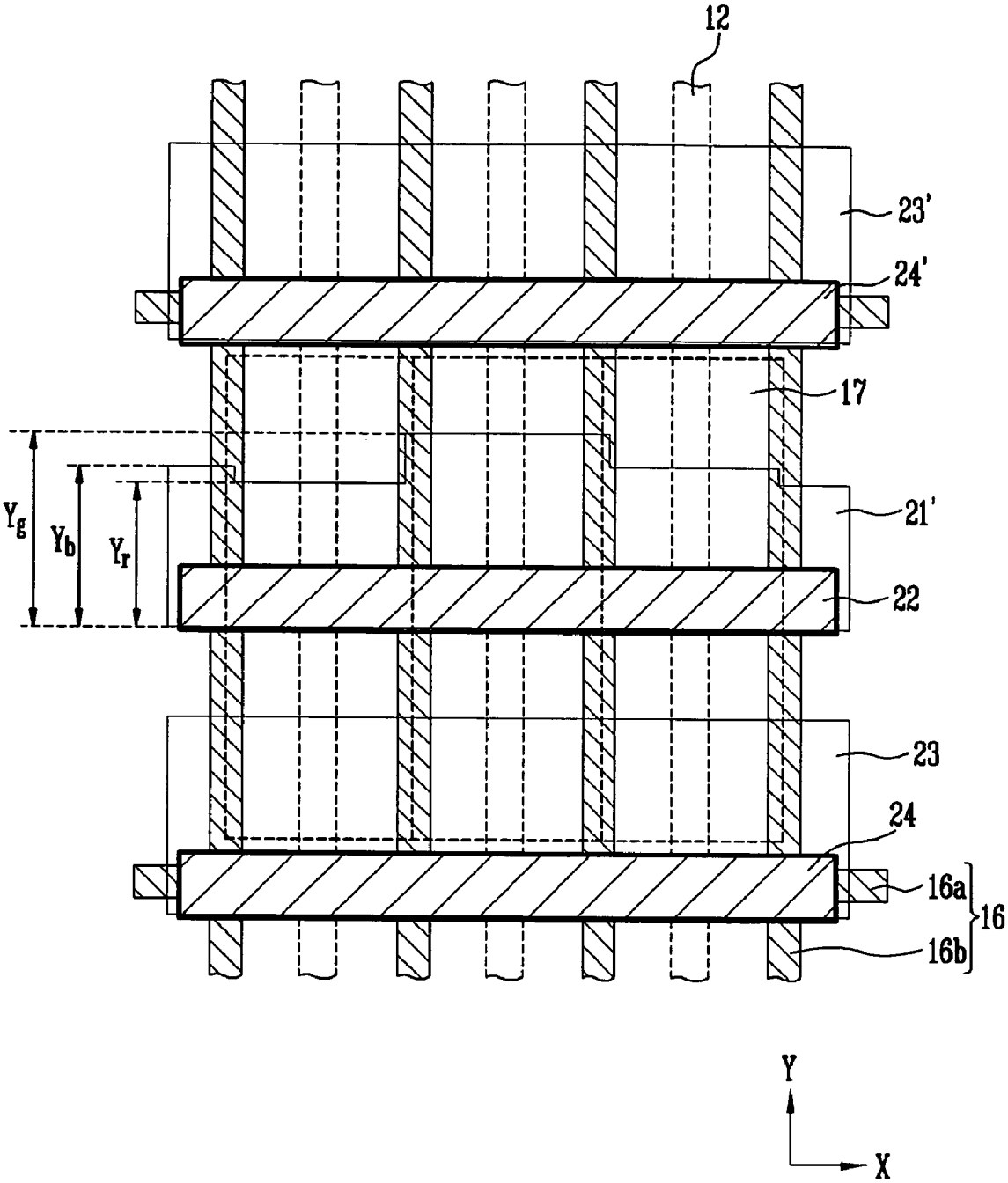
FIG. 4A illustrates a partial plan view of a cell structure of a PDP according to another example embodiment.
Figure 4B:
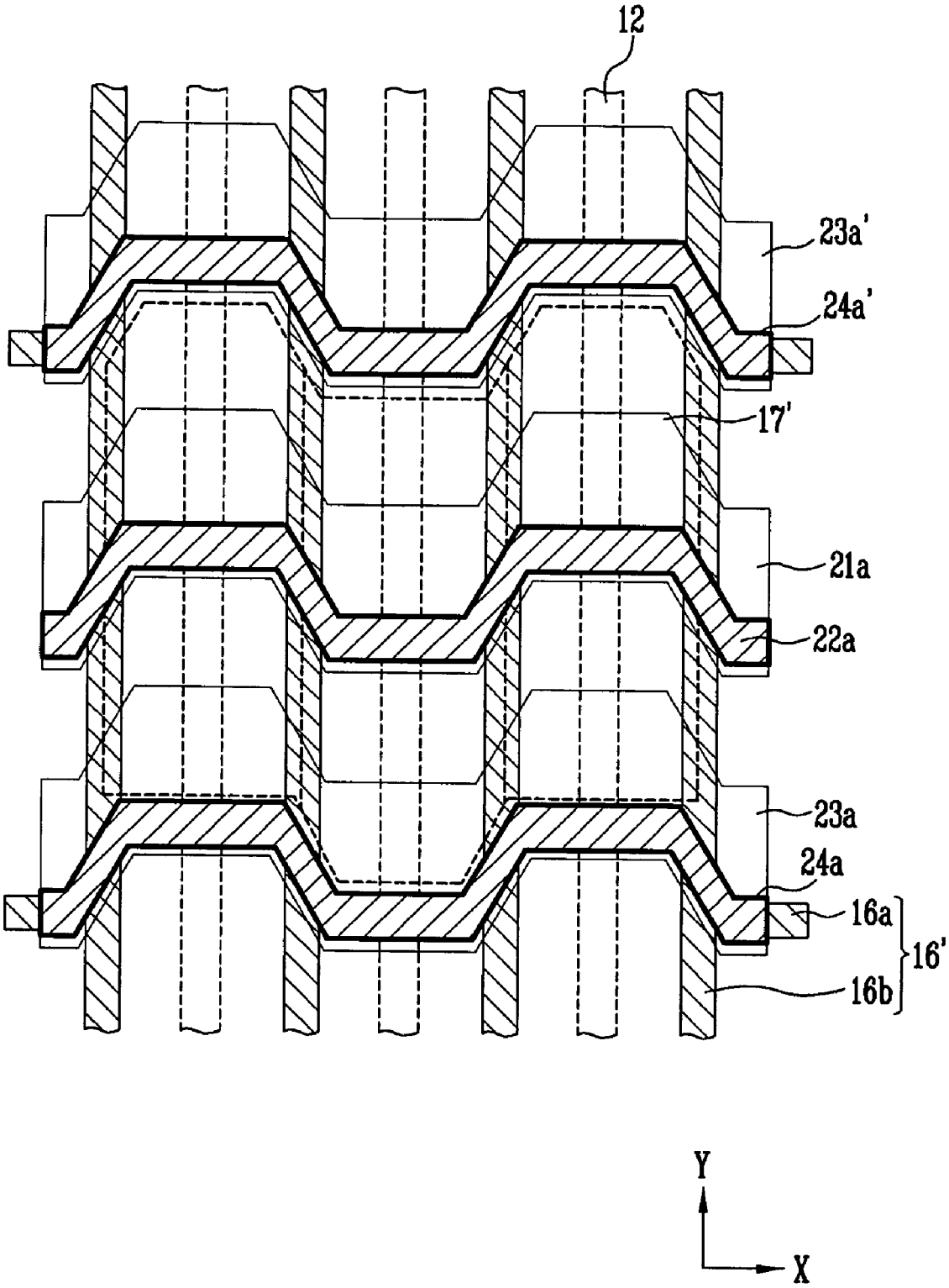
FIG. 4B illustrates a partial plan view of a cell structure of a PDP according to another example embodiment.

FIGS. 4A and 4B illustrate partial plan views of cell structures in PDPs according to other example embodiments. In FIG. 4A, a PDP may be substantially the same as the PDP 100*a* of FIGS. 2-3, with the exception of having non-uniform widths of scan electrodes 21'. In FIG. 4B, a PDP may be substantially the same as the PDP 100*a* of FIGS. 2-3, with the exception of the electrodes including a bent portion.

Referring to FIG. 4A, a PDP may include a scan electrode 21' with a non-uniform width along the second direction, i.e., along the y-axis. In particular, an area, i.e., width, of each portion of the scan electrode 21' may be changed according to a corresponding discharge cell 17 and its respective phosphor. For example, as illustrated in FIG. 4A, the scan electrode 21' may have different widths Yr, Yg, and Yb in three adjacent, i.e., along the x-axis, discharge cells 17. The different widths Yr, Yg, and Yb may be adjusted according to the phosphor 18, which may be arranged to extend in the first direction according to difference in luminance for red phosphor 18R, green phosphor 18G, and blue phosphor 18B, external color of panel, i.e., difference in reflecting color, difference in deterioration life, etc. For example, the width Yg of a portion of the scan electrode 21' may correspond to a discharge cell 17 with green phosphor 18G, and may have a larger width along the second direction, i.e., along the y-axis, than widths Yb and Yr. Accordingly, in order to enhance natural display, e.g., of colors, on the screen of the PDP, when a cell arrangement is changed, e.g., different phosphors are used, different widths of the scan electrode 21' may correspond to different discharge cells 17 to adjust, e.g., luminance of different phosphor colors, and improve display uniformity of the PDP.

Referring to FIG. 4B, a PDP may include scan electrodes 21*a*, first bus electrodes 22*a*, sustain electrodes 23*a*, and second bus electrodes 24*a*, which may correspond to respective scan electrodes 21, first bus electrodes 22, sustain electrodes 23, and second bus electrodes 24 discussed previously, with the exception of including a bent portion. In particular, at least one of the scan electrodes 21*a*, first bus electrodes 22, sustain electrodes 23, and second bus electrodes 24 may include a bent portion extending in the first direction, i.e., along the x-axis, according to the barrier rib 16' and/or the arrangement of the discharge cell 17'.

For example, the first bus electrode 22*a* may extend, e.g., meanderingly, in the first direction and may include at least one linear portion and at least one bent portion connected to the linear portion. The linear and bent portions may extend in the first direction. For example, the linear portion may extend across an address electrode 12, and the bent portion may correspond to a second barrier rib 16 and connect two adjacent linear portions along the first direction. The first bus electrode 22*a* may extend along the first direction along the central portion of the discharge cell 17, e.g., along central portions of a plurality of discharge cells 17 arranged adjacently to each other along the first direction. Also, the first bus electrode 22*a* may be arranged along a side of the scan electrode 21*a* facing the sustain electrode 23*a* of a same discharge cell 17, i.e., across a discharge gap of the same discharge cell 17.

The scan electrode 21*a* may contact the first bus electrode 22*a*, and may have a wider width than the first bus electrode 22*a* along the second direction. The scan electrode 21*a* may extend, e.g., meanderingly, together with the first bus electrode 22*a*. An adjacent sustain electrode 23*a*' and an adjacent second bus electrode 24', i.e., electrodes corresponding to an adjacent discharge cell 17, may be arranged at a predetermined gap with respect to the scan electrode 21*a*, i.e., the scan electrode 21 may be between the sustain electrode 23*a* and the adjacent sustain electrode 23'.

The second bus electrode 24*a* may extend in the first direction, i.e., along the x-axis, and may extend, e.g., meanderingly, along the first barrier ribs 16*a* to be overlapped, e.g., completely overlapped, by the first barrier ribs 16*a*. Also, the second bus electrode 24*a* may be arranged along an edge of the sustain electrode 23*a* opposite an edge facing the scan electrode 21*a*. The sustain electrode 23*a* may contact the second bus electrode 24*a*, may have a wider width than the second bus electrode 24*a*, and may extend, e.g., meanderingly, in the first direction together with the second bus electrode 24*a*.

According to the example embodiment of FIG. 4B, in order to enhance natural display, e.g., of curves, on the screen of the PDP, when a cell arrangement is changed, the first bus electrode 22*a* may extend, e.g., meanderingly, along the bent portions, to correspond to the central portions of the changed discharge cells 17 to adjust display properties according to the changed cell arrangement.

Figure 5:
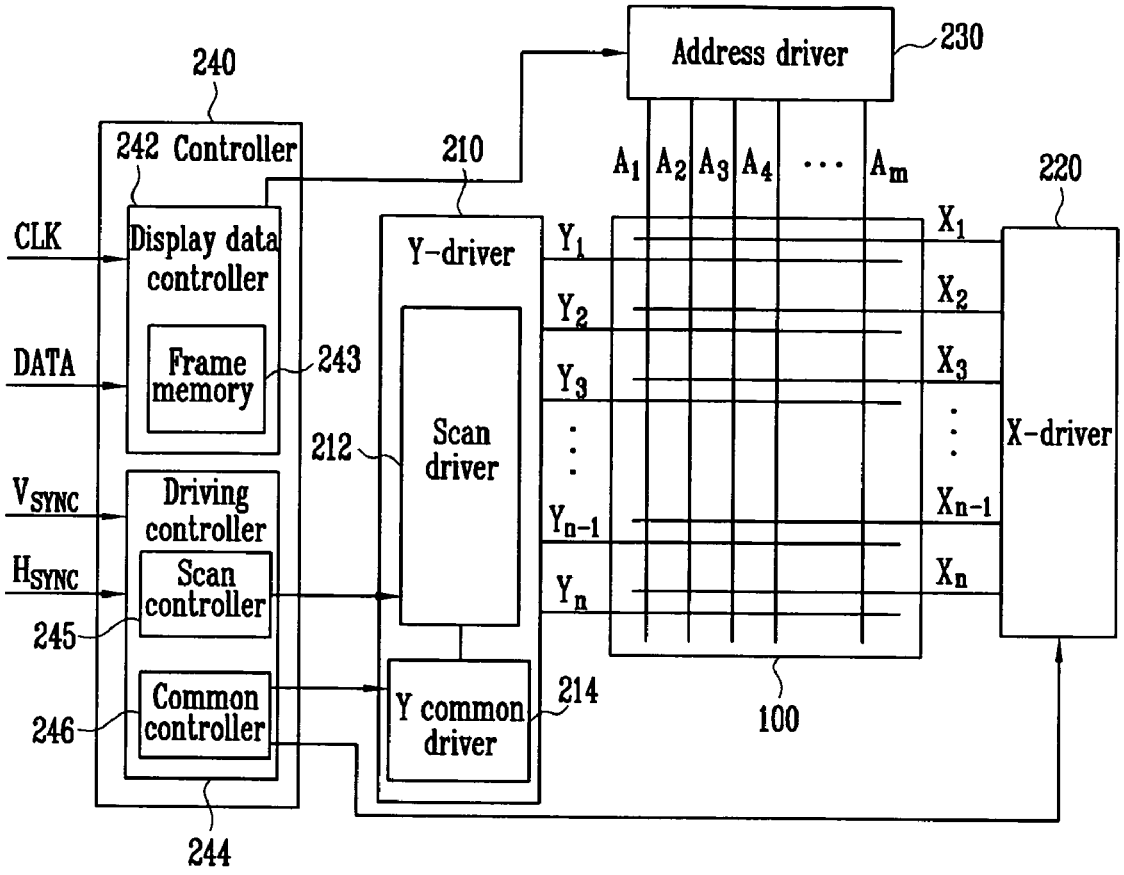
FIG. 5 illustrates a block diagram of a PDP according to an example embodiment.

FIG. 5 illustrates a block diagram of a PDP according to example embodiments.

Referring to FIG. 5, the PDP may include a panel unit 100, where several tens to several millions discharge cells 17 may be arranged, e.g., in the matrix form, and a driver driving the panel unit.

The panel unit 100 may be the PDP 100 discussed previously with reference to FIG. 1. It is noted, however, that the panel unit 100 may be replaced with any of the PDPs discussed previously with reference to FIGS. 2-4B. The panel unit 100 may include the pair of substrates facing each other, barrier ribs partitioning a discharge space into the discharge cells arranged between the pair of substrates, the group of electrodes arranged between the pair of substrates and generating the discharge in the discharge cell, and phosphors emitting light by the discharge. Herein, the group of electrodes may include a plurality of scan electrodes extended to the first direction, a plurality of sustain electrodes extended in the first direction to be parallel with each scan electrode, and a plurality of address electrodes extended in the second direction orthogonal to the first direction. In particular, the panel unit 100 may include the first bus electrode of the scan electrode arranged on the intermediate portion, i.e., central portion, of the discharge cell and the second bus electrode of the sustain electrode arranged on the barrier rib. Further, the first bus electrode and the second bus electrode may be substantially arranged at equidistance.

The aforementioned substrates may include, e.g., a glass substrate. The group of electrodes may include a conducive material. In particular, the scan electrode and the sustain electrode may include transparent electrodes, e.g., of transparent material, and respective first and second bus electrodes, which may exhibit lower electric resistance than the transparent electrodes, e.g., configured of a material not reacting with a dielectric. For example, the material of the transparent electrodes may include, e.g., one or more of ITO, $SnO_2$, ZnO, and CdSnO. The material of the bus electrodes may include, e.g., one or more of gold (Au), silver (Ag), etc. Inert mixed gases, e.g., one or more of He, Ne, and Xe, may be injected into the discharge cells 17.

The driver may include a Y-driver 210 driving a plurality of scan electrodes Y1, Y2, Y3, . . . , Yn-1, and Yn, an X-driver 220 driving a plurality of sustain electrodes X1, X2, X3, . . . , Xn-1, and Xn, an address driver 230 driving a plurality of address electrodes A1, A2, A3, A4, . . . ,Am-1, and Am, and a controller 240 generating a scan control signal, a sustain discharge signal, and an address control signal and transferring them to each driver 210, 220, and 230.

The controller 240 may include a display data controller 242 and a driving controller 244. The display data controller 242 may include a frame memory 243, and the driving controller 244 may include a scan controller 245 and a common controller 246.

The controller 240 may receive a clock signal CLK, a data signal DATA, a vertical synchronization signal $V_{SYNC}$, and a horizontal synchronization signal $H_{SYNC}$ from the external. The display data controller 242 may store the data signal DATA in the internal frame memory 243 according to the clock signal CLK, and may transfer a corresponding address control signal to the address driver 230. The driving controller 244 may process the vertical synchronization signal $V_{SYNC}$ and the horizontal synchronization signal $H_{SYNC}$. The scan controller 245 may generate signals controlling a scan driver 212 of the Y-driver 210, and the common controller 246 may generate signals controlling a Y-common driver 214 of the Y-driver 210 and the X-driver 204.

The address driver 230 may process the address control signal of the display data controller 242 to apply the display data signals corresponding to an address step to the address electrodes A1, A2, . . . , Am-1, and Am of the panel unit 100.

The Y-driver 210 may include the scan driver 212 and the Y-common driver 214. The scan driver 212 may apply the corresponding scan driving signals to each scan electrode Y1, Y2, . . . , Yn-1, and Yn in the address step according to the control signal. The Y-common driver 214 may simultaneously apply the common driving signals to the scan electrodes Y1, Y2, . . . , Yn-1, and Yn according to the control signal of the common controller 246.

The X-driver 220 may simultaneously apply the common driving signals to the sustain electrodes X1, X2, . . . , Xn-1, and Xn in the sustain discharge step according to the control signal of the common controller 246.

The aforementioned PDP may be driven by dividing one frame into a plurality of subfields. Each subfield may be configured of a reset period, an address period, and a sustain period. The reset period may be a period initializing the state of each state in order to smoothly perform the addressing operation in the cell and the address period may be a period performing the operation accumulating wall charges on the cell by selecting turned-on cells and turned-off cells in the panel unit 100. The sustain period may be a period performing the discharge for actually displaying images on the turned-on cells.

With the present embodiment, in the PDP, the discharge margin may be expanded and the efficiency may be improved in all the load regions.

That is, in example embodiments, the first bus electrode of the scan electrode may be positioned at a central portion of a discharge cell to provide asymmetry of the address discharge. Therefore, the asymmetric address discharge may provide low-voltage drivable PDP. Also, the second bus electrode of the sustain electrode may be positioned on the barrier rib to maximize the discharge cell and limit current, thereby increasing a driving voltage margin in an entire load of the PDP. Further, the PDP according to example embodiments may have a higher aperture ratio than a conventional simple square barrier rib structure and a larger discharge cell than a conventional double barrier rib structure, thereby increasing efficiency in all load regions of the PDP.

Example embodiments of the present invention have been disclosed herein, and although specific terms may be employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a pair of substrates facing each other;

barrier ribs defining discharge cells between the pair of substrates;

sustain electrodes between the pair of substrates, the sustain electrodes including second bus electrodes along a first direction, the second bus electrodes being on the barrier ribs, the sustain electrodes including second transparent electrodes;

scan electrodes between the pair of substrates, the scan electrodes including first bus electrodes along the first direction, the first bus electrodes being positioned between adjacent second bus electrodes, the scan electrodes including first transparent electrodes;

address electrodes between the pair of substrates, the address, scan, and sustain electrodes being configured to generate discharge in the discharge cells; and phosphors in the discharge cells, the phosphors being configured to emit light by the discharge;

wherein at least the first bus electrodes and/or the second bus electrodes include at least one linear portion extending across an address electrode and at least one bent portion extending across a barrier rib, the at least one bent portion being connected to the at least one linear portion, and at least the first transparent electrodes and/or second transparent electrodes include at least one transparent linear portion extending across the address electrode and at least one transparent bent portion extending across the barrier rib, the at least one transparent bent portion being connected to the at least one transparent linear portion.

2. The PDP as claimed in claim 1, wherein the first bus electrodes are positioned at substantially equal distances from both adjacent second bus electrodes, the distances being measured along a second direction orthogonal to the first direction.

3. The PDP as claimed in claim 1, wherein:

the scan electrodes include first transparent electrodes contacting the first bus electrodes, the first transparent electrodes being wider than the first bus electrodes along a second direction orthogonal to the first direction, the sustain electrodes include second transparent electrodes contacting the second bus electrodes, the second transparent electrodes being wider than the second bus electrodes along the second direction, the first bus electrodes are arranged on first sides of the first transparent electrodes, the first sides of the first transparent electrodes facing first sides of the second transparent electrodes, the first sides of the first and second transparent electrodes defining a discharge gap therebetween, and the second bus electrodes are arranged on second sides of the second transparent electrodes, the second sides of the second transparent electrodes being opposite the first sides of the second transparent electrodes.

4. The PDP as claimed in claim 3, wherein the first transparent electrodes and the second transparent electrodes extend in the first direction.

5. The PDP as claimed in claim 1, wherein:

the scan electrodes include first transparent electrodes contacting the first bus electrodes, the first transparent electrodes being wider than the first bus electrodes along a second direction orthogonal to the first direction, the sustain electrodes include second transparent electrodes contacting the second bus electrodes, the second transparent electrodes being wider than the second bus electrodes along the second direction, widths of the first transparent electrodes along the second direction extend from a central portion between two adjacent barrier ribs toward one of the adjacent barrier ribs, and widths of the second transparent electrodes along the second direction extend from the other one of the adjacent barrier ribs toward the central portion between the adjacent barrier ribs to define a discharge gap between the central portion and the other one of the adjacent barrier ribs.

6. The PDP as claimed in claim 5, wherein the first transparent electrodes and the second transparent electrodes extend in the first direction.

7. The PDP as claimed in claim 1, wherein the scan electrodes have non-uniform widths along a second direction, the second direction being substantially orthogonal to the first direction.

8. The PDP as claimed in claim 7, wherein the scan electrodes have different widths in each discharge cell, the widths being configured according to phosphor luminance in respective discharge cells.

9. The PDP as claimed in claim 1, wherein the barrier ribs include a first barrier rib extending in the first direction and a second barrier rib extending in a second direction substantially orthogonal to the first direction.

10. The PDP as claimed in claim 1, wherein the barrier ribs completely overlap the second bus electrodes, and the first bus electrodes extend between adjacent barrier ribs along center portions of the discharge cells.

11. The PDP as claimed in claim 10, wherein each first bus electrode extends along an entire length of at least one corresponding discharge cell.

12. The PDP as claimed in claim 10, wherein each first bus electrode extends along a plurality of corresponding discharge cells.

13. The PDP as claimed in claim 1, wherein the scan and sustain electrodes include respective first and second transparent electrodes on corresponding first and second bus electrodes to define a discharge gap therebetween, the first and second bus electrodes and the first and second transparent electrodes being positioned to define the discharge gap to be offset with respect to a center of the discharge cell.

14. The PDP as claimed in claim 1, wherein the first transparent electrodes contact the first bus electrodes and/or the second transparent electrodes contact the second bus electrodes, and the first transparent electrodes have a wider first width than the first bus electrodes and/or the second transport electrodes have a wider second width than the second bus electrodes.

15. A plasma display panel (PDP), comprising:

a pair of substrates facing each other;

barrier ribs defining discharge cells between the pair of substrates;

sustain electrodes between the pair of substrates, the sustain electrodes including second bus electrodes along a first direction, the second bus electrodes being on the barrier ribs;

scan electrodes between the pair of substrates, the scan electrodes including first bus electrodes along the first direction, the first bus electrodes being positioned between adjacent second bus electrodes;

address electrodes between the pair of substrates, the address, scan, and sustain electrodes being configured to generate discharge in the discharge cells; and phosphors in the discharge cells, the phosphors being configured to emit light by the discharge;

wherein at least the first bus electrodes and/or the second bus electrodes include at least one linear portion extending across an address electrode and at least one bent portion extending across a barrier rib, the at least one bent portion being connected to the at least one linear portion, the barrier ribs completely overlap the second bus electrodes, and the first bus electrodes extend between adjacent barrier ribs along center portions of the discharge cells.

16. The PDP as claimed in claim 15, wherein each first bus electrode extends along an entire length of at least one corresponding discharge cell.

17. The PDP as claimed in claim 15, wherein each first bus electrode extends along a plurality of corresponding discharge cells.

* * * * *